United States Patent [19]

Yamada et al.

[11] Patent Number: 4,674,127

[45] Date of Patent: Jun. 16, 1987

[54] LINER BAG FOR USE IN CONTAINERS

[75] Inventors: Hideo Yamada; Shigemi Ichiki; Hisamoto Naniwa; Susumu Uchida; Kenji Kadokura; Susumu Tsunoda; Kunio Nakajima, all of Tokyo, Japan

[73] Assignees: Nippon Yusen Kaisha; Nihon Matai Co., Ltd., both of Tokyo, Japan

[21] Appl. No.: 879,431

[22] Filed: Jun. 27, 1986

[30] Foreign Application Priority Data

Jun. 29, 1985 [JP] Japan ..... 59-99274[U]

[51] Int. Cl.[4] ..... B65D 33/06

[52] U.S. Cl. ..... 383/6; 383/12; 383/16; 383/21; 383/22; 220/404; 220/410

[58] Field of Search ..... 383/6, 12, 13, 16, 17, 383/18, 21, 22, 2, 119, 117, 122, 121; 220/85 B, 403, 461, 404, 410

[56] References Cited

U.S. PATENT DOCUMENTS

| | | | |
|---|---|---|---|
| 3,674,073 | 7/1972 | Hendon | 383/24 |
| 3,838,758 | 10/1974 | Brown | 383/2 |
| 3,951,284 | 4/1976 | Fell et al. | 383/100 |
| 3,965,953 | 6/1976 | Becker et al. | 383/6 |
| 4,364,424 | 12/1982 | Nattrass | 383/24 |
| 4,390,051 | 6/1983 | Cuthbertson | 383/17 |
| 4,461,402 | 7/1984 | Fell et al. | 383/119 |
| 4,610,028 | 9/1986 | Nattrass | 383/17 |

*Primary Examiner*—Willis Little

*Attorney, Agent, or Firm*—Cushman, Darby & Cushman

[57] ABSTRACT

The liner bag for use in containers comprises a bag main body having bottom, side, front and upper faces corresponding to the configuration on the inner walls of a container, in which the joining edge between the upper face and the side face is bent convexly toward the opposed joining edge, engaging members for detachably engaging the bag main body near the upper and lower four corners on the front thereof to the container, a pair of engaging metal members attached respectively to the two upper corners on the container door side and a pair of side belts which are attached along the joining edges between the upper face and both of the side faces, the ends of which are led out from the ends of the upper face on the door side and in which the led out portions are clamped with each other after being engaged to the engaging metal members. The liner bag can easily be installed to and removed from the container and the sagging in the upper face of the liner bag can be prevented without reducing the volume thereof.

4 Claims, 22 Drawing Figures

LINER BAG FOR USE IN CONTAINERS

BACKGROUND OF THE INVENTION

1. Field of the Invention

This invention concerns a liner bag for use in containers employed for transporting granular goods or bulks such as malts, grains, feed stocks and sands or smelly goods such as hides and, more specifically, it relates to a liner bag for use in containers capable of effectively preventing sagging in the upper face of a liner bag main body installed to the inside of a container.

2. Description of the Prior Art

Granular goods such as malts, grains, feed stocks and sands are generally transported on bulk containers, for example, having three manholes of about 50 cm diameter formed at the ceiling, and it has also been attempted to transport such granular goods by using dry containers.

By the way, in the case of transporting granular goods on a container, it is necessary to wash the inside of the container after every transportation so that goods transported formerly have no undesired effects on the goods to be transported subsequently.

However, the washing work is not always easy even in bulk containers which can be washed relatively easily and, moreover, the containers can not be used again till the inside thereof is completely dried after the washing. Particularly, the dry containers involve a problem upon transporting food goods from the sanitary point of view since the washing procedures are not easy and various kinds of goods are handled in the dry containers.

In addition, while smelly hides are usually transported on dry containers, keenly smelling water droplets are deposited to the inner walls, particularly, to the bottom walls of the containers and can not completely be deodorized by usual washing. Further, since the droplets contain salts, they cause the problem of corrosion in the containers.

For overcoming the foregoing problems, it has heretofor been proposed, for example, as disclosed in U.S. Pat. No. 3,951,284 (Canadian Pat. No. 948039) and U.S. Pat. No. 4,461,402 (Canadian Pat. No. 1179613) that an inner liner or a liner bag is installed to the inside of a container and a plurality of tabs disposed spaced apart from each other along the upper circumferential edge of the liner bag are engaged to hooks disposed at the periphery of the container directly or by way of stretcheable connectors, so that the liner bag is secured to the inside of the container. By the use of the liner bag as disclosed above, a dry container can be utilized as a bulk container and complete washing for the inside of the container can be saved.

However, since the liner bag has to be secured to the inside of the container by engaging the liner bag at a plurality of positions along the circumferential edge of the upper face to the container in the conventional container liner bag of this kind, the work of installing and removing the liner bag to and from the container is not easy, as well as a considerable modification is necessary for the structure of the container such as of attaching a plurality of hooks to the container.

Further, since the engagement of the liner bag to the container more or less requires clearance relative to the container wall, sagging is inevitably resulted to the upper face of the liner bag even when the bag is engaged by a plurality of positions on the circumferential edge of the upper face to the container.

In the case where the tabs of the liner bag are engaged to the container by way of the stretcheable connectors respectively, although the sagging at the upper face of the liner bag can be decreased as compared with the case of direct engagement, the volume of the liner bag is reduced by the length of the connectors to result in a fetal defect that a desired amount of goods can not be contained.

SUMMARY OF THE INVENTION

It is, accordingly, an object of this invention to provide a liner bag or inner liner for use in containers that can readily be installed to and removed from a container and prevent the sagging at the upper face without reducing the volume of the liner bag.

It is another object of this invention to provide an liner bag for use in containers capable of easily deforming along with the shape of the inner walls of a container thereby preventing the liner bag from breakage upon charging goods to the inside thereof.

The foregoing objects of this invention can be attained by a liner bag for use in containers comprising;

a liner bag main body having a bottom face at least covering the container bottom wall, a pair of side faces covering both of the container side walls, a front face covering the container front wall and an upper face covering the container upper wall, in which a joining edge between the upper face and at least one of the side faces is curved convexly toward the joining edge with the other side face;

engaging members for detachably engaging the portions near the upper and lower four corners of the bag main body on the front side respectively to the container;

a pair of engaging metal members attached respectively to two upper corners of the container on the side of a door; and a pair of side belts which are attached along the joining edges between the upper face and both of the side faces respectively, the ends of which are led out from the end of the upper face on the side of the door and in which the led out portions are clamped with each other after being engaged to the engaging metal members respectively.

The operation of installing the liner bag main body to the container can be completed in this invention by merely engaging the bag main body at the positions near the upper and lower four corners on the front side to the container by way of the engaging members and engaging the portions of the pair of the side belts led out from the upper face with each other after engaging them respectively to the engaging metal members on the container. Further, in the case of removing the bag main body from the container, the detaching operation can be completed by reversing the above-mentioned procedures. Thus, the bag main body can easily be installed to or removed from the container.

Further, since the joining edge between the upper face and at least either one of the side faces of the bag main body is curved convexedly toward the side of the joining edge with the other side face, the upper face is pulled both in the longitudinal and lateral directions when both of the side belts are clamped with each other, by which the sagging in the upper face can be removed. Furthermore, since the sagging in the upper face is eliminated by pulling both of the side belts toward the door of the container, no large gap is necessary between the upper face of the liner bag and the ceiling of the container, undesirable reduction in the volume of the bag main body can be avoided.

BRIEF DESCRIPTION OF THE ACCOMPANYING DRAWINGS

These and other objects, as well as features of this invention will be better understood by reading the detailed descriptions for preferred embodiments while referring to the appended drawings, wherein FIG. 1 is an explanatory view showing the state of a liner bag according to this invention installed to a dry container;

Figure 5:
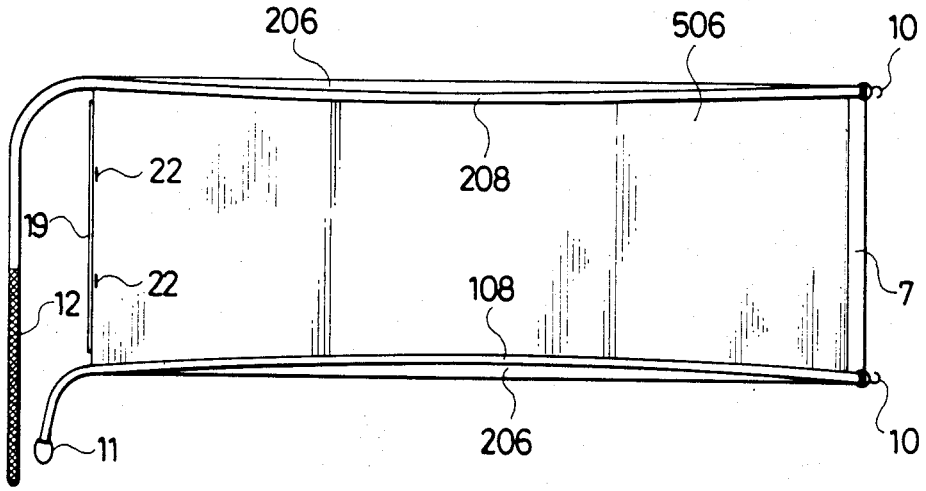
Figure 6:
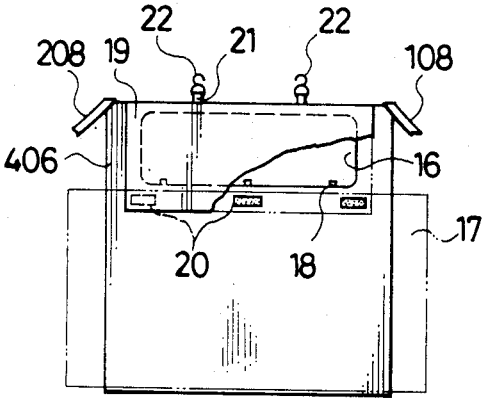
Figure 7:
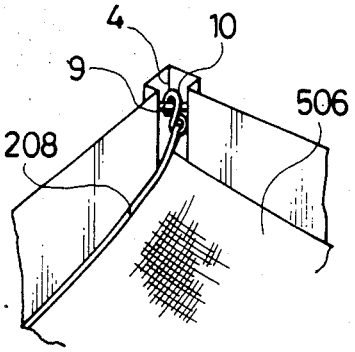
Figure 8:
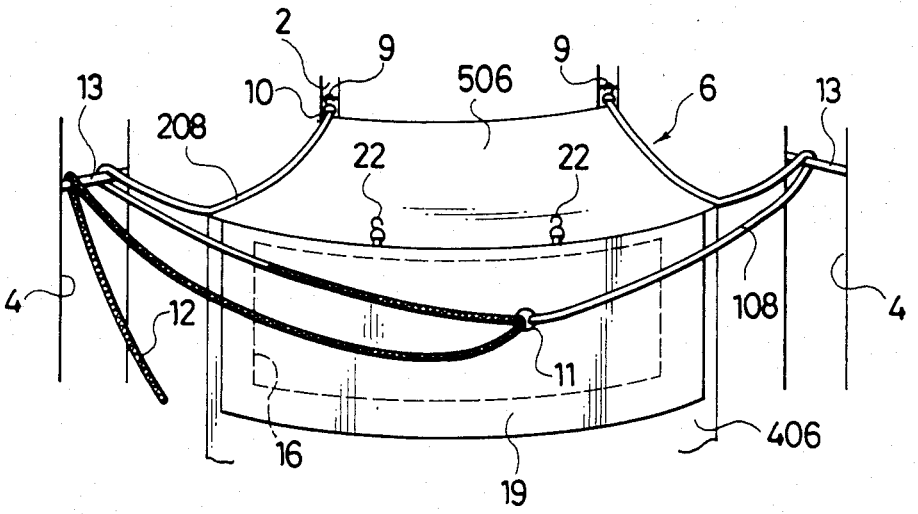
Figure 9:
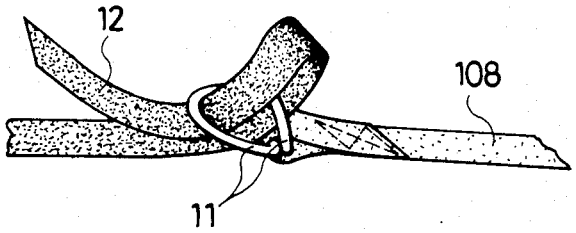

FIG. 5 plan view of that portion;

FIG. 6 is a side elevational view of the liner bag as viewed from the side of the door;

FIG. 7 is an explanatory view showing the state of the liner bag when the upper ends on the front side are engaged to the container;

FIG. 8 is an explanatory view showing the state of the liner bag when it is engaged at four upper corners to the container;

FIG. 9 is an explanatory view showing the state of the side belt and the buckle metal when they are connected with each other;

FIGS. 10 through 15 are explanatory views respectively showing other embodiments according to this invention regarding the charging port.

Figure 18:
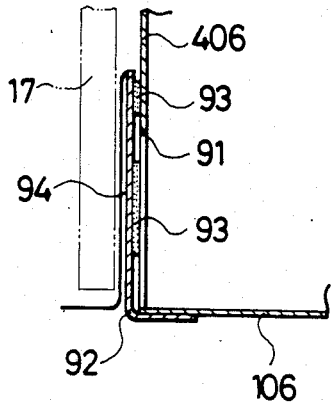
Figure 19:
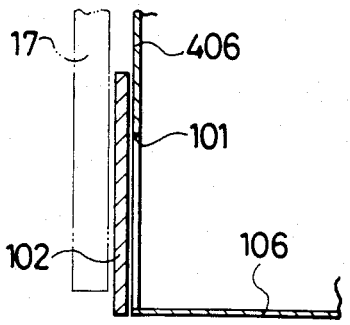
Figure 20:
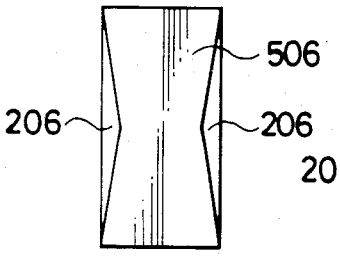
Figure 21:
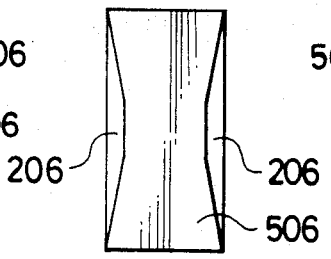
Figure 22:
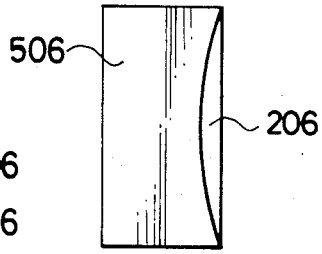

FIGS. 16 through 19 are explanatory views respectively showing further embodiments according to this invention, regarding the discharging port; and FIGS. 20 through 22 are explanatory views respectively showing still further embodiments according to this invention, regarding the bent shape of the upper face.

DESCRIPTION OF THE PREFERRED EMBODIMENTS

Preferred embodiments according to this invention will now be explained below while referring to the drawings.

Figure 1:
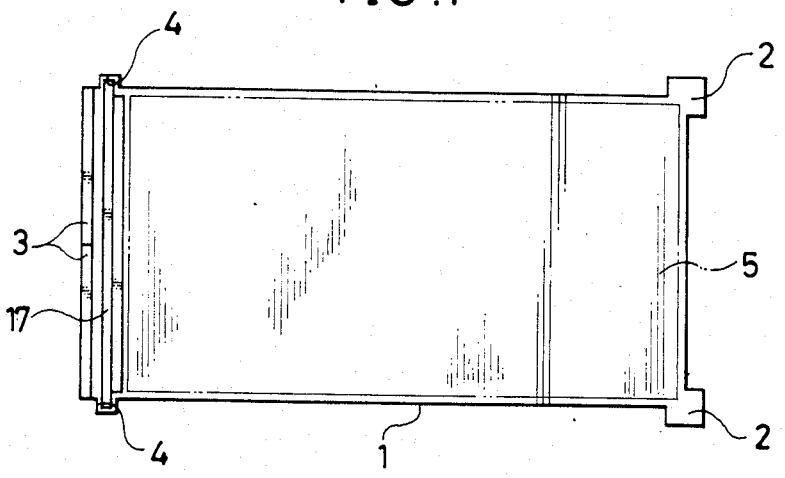

Referring at first to FIG. 1, a dry container 1 has square grooves 2 at the corners on the front side and recessed grooves 4 at the corner on the side of doors 3, and a liner bag 5 is detachably installed to the inside of the container 1.

As shown in FIGS. 2 through 6, the liner bag 5 comprises a bag main body 6 in the shape of a tightly closed rectangular box conforming the inner shape of the dry container 1 and it is composed of a bottom face 106 covering the container bottom wall, a pair of side faces 206 covering the container side walls, a front face 306 covering the container front wall, a door face 406 covering the container door wall and an upper face 506 covering the container ceiling wall. The bag main body 6 is made of water-proof material in a three-layered structure comprising a core material, for example, made of a polyolefinic resin film or polyolefinic fibers knitted in a net-like or fabric-like form and polyolefinic resin films disposed on both sides thereof. The bag main body 6 can be folded compact when it is not used.

Figure 3:
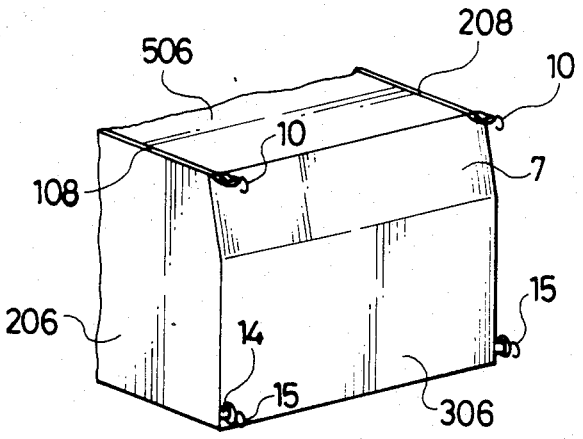
FIG. 3 is a perspective view for a portion of the liner bag illustrated in FIG. 2 as viewed from the side of the front face.
Figure 4:
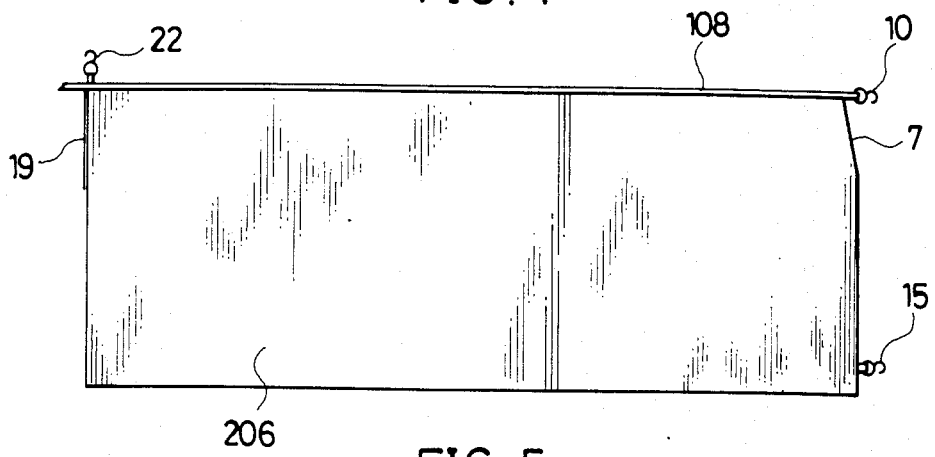
FIG. 4 is a front elevational view of that portion.

As shown in FIGS. 3 and 4, the bag main body 6 is orthogonally cut at the upper portion of both of the side faces 206 on the side of the container front wall and the front face 306 is joined integrally with the side faces 206 along with the cut edge. In this way, the upper portion of the front face 306 is formed as a sloped plane 7 gradually inclined to the door face 406 toward the joining edge with the upper face 506 as shown in FIGS. 3 through 5.

Further, in the upper face 506 of the liner bag main body 6, each of the joining edges joined with the side faces 206 is formed into an arcuate shape convexing inwardly with its longitudinal center being as the crest as shown in FIG. 5. Side belts 108 and 208, for example, made of polypropylene are integrated with the joining edges respectively by means of stitching or welding. Thus, the upper face 506 is adapted to be pulled both in the longitudinal and lateral directions by longitudinally pulling both of the side belts 108 and 208, by which the sagging in the upper face 506 can effectively be prevented.

The ends of the side belts 108 and 208 on the side of the container front wall are pulled out from both of the upper corners of the bag main body 6 on the front side each in a ring-like shape as shown in FIG. 3. An upper end hook 10 detachably engaged to an engaging metal 9 disposed in the square groove 2 of the dry container 1 is attached to the ring portion as shown in FIGS. 2, 4, 5, 7 and 8. Further, the ends of the side belts 108 and 208 on the side of the container door wall are led out from both of the upper corners of the bag main body 6 on the door side. A buckle metal 11 composed of two rings is attached to the end of the side belt 108, while a cotton belt 12 is attached to the end of the side belt 108 respectively. Both of the upper ends of the bag main body 6 are detachably engaged to the corners of the dry container 1 on the door side by engaging the ends of the side belts 108 and 208 respectively to the engaging metals 13 disposed within the recessed grooves 4 of the dry container 1 as shown in FIG. 8 and, thereafter, pulling the end of the cotton belt 12 through the buckle metal 11 as shown in FIG. 9.

Figure 2:
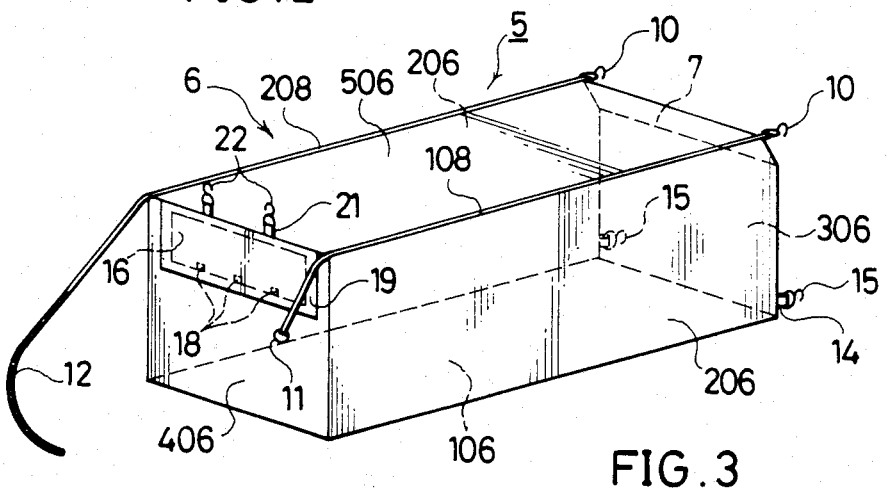
FIG. 2 is a perspective view for one embodiment of the liner bag for use in granular goods which is applied to a dry container.

Further, ring belts 14 made of the same material as that of the side belts 108 and 208 are attached to the joining edge between each of the side faces 206 and the front face 306 at the position deviated upwardly from the lower end by a predetermined height as shown in FIGS. 2 through 4. Each of the ring belts 14 is attached with a lower end hook 15, which is detachably engaged to an engaging metal (not illustrated) disposed within the square groove 2 of the dry container 1.

Further, a laterally extended charging port 16 is formed to the upper portion of the door face 406 as shown in FIGS. 2 and 6, and granular goods are charged through the charging port 16 to the inside of the liner bag main body 6. The charging port 16 also serves as a monitor window upon inspecting the goods. At the lower edge of the discharging port 16, are disposed three snap-buttons 18 for provisionally securing the upper part of a bulkhead or retainer panel 17, which is detachable mounted to the recessed grooves 4 of the dry container 1 for supporting the lower portion of the door face 406.

Instead of the snap-buttons 18, a longitudinal flap may be formed over the entire length along the lower edge of the discharging port 16 so that the flap covers the upper end of the bulkhead 17 and is then secured to the outer surface thereof by means of strings or the likes.

As shown in FIGS. 2 and 6, a closing cover 19 in a rectangular shape made of the same material as that for the bag main body 6 is disposed to the outside of the charging port 16 and integrally secured at the upper edge thereof with the upper edge of the door face 406. The lower end of the closing cover 19 is provisionally secured to the door face 406, for example, by means of velvet fastners 20.

Further, as shown in FIG. 6, two ring belts 21 made of the same material as that for the ring belts 14 are attached to the upper edge of the door face 406, and antisagging hooks 22 engaged detachably to the stretched side belts 108 and 208 as shown in FIG. 8 are attached to the ring belts 21 respectively.

Operation of the liner bag having thus been constituted will now be described.

In the case of transporting granular goods by using the dry container 1, the upper and lower end hooks 10 and 15 on the front side of the liner bag 5 are engaged with the engaging metals 9 disposed within the square grooves 2 of the dry container 1.

Then, the ends of the side belts 108 and 208 on the side of the door 3 are engaged to the engaging metals 13 disposed within the recessed grooves 4 of the dry container 1 as shown in FIG. 8, while the cotton belt 12 is passed through the buckle metal 11 and, further, the end of the cotton belt 12 is pulled downwardly while being hooked on the engaging metal 13 as shown in FIG. 9. Then, each of the side belts 108 and 208 is pulled longitudinally and the liner bag main body 6 is securely installed to the inside of the dry container 1. In this instance, since the respective side belts 108 and 208 are attached each in an arcuate shape convexing inside along both of the side edges of the upper face 506 as shown in FIG. 5, each of the side belts 108 and 208 tends to be straightened when pulled longitudinally, by which the upper face 506 is pulled both in the longitudinal and the lateral directions. Accordingly, sagging in the upper face 506 can effectively be prevented.

After the liner bag main body 6 has been mounted to the inside of the dry container 1, the anti-sagging hooks 22 are engaged to the side belts 108 and 208 and the bulkhead 17 is mounted by utilizing the recessed grooves 4 on both sides, to support the lower portion of the door face 406 with the bulkhead 17, and the snap-buttons 18 are 8snapped to the engaging portion (not shown) of the bulkhead 17.

Then, the closing cover 19 is opened and granular goods such as malts are changed through the charging port 16 to the inside of the bag main body 6 by using, for example, a screw conveyor. Then, the bag main body 6 is entirely pulled downwardly due to the weight of the goods and also urged outwardly. Accordingly, the joining edge between the side faces 206 and the front face 306 are pushed to the outside and bulged into the square grooves 2.

In this case, if the front face 306 is in a flat configuration, a compulsory force may possibly be exerted on the front face 306 or the upper end hook 10 due to the bulging movement to possibly break the bag main body 6 from this portion.

In this embodiment, however, since the sloped plane 7 is formed at the upper end of the front face 306 and the sloped plane 7 is engaged at both of the upper end corners thereof to the engaging metals 9 by means of the upper end hooks 10, sagging is resulted at the portion below the sloped plane 7 of the front face 306 in the state where the bag main body 6 is attached to the inside of the dry container 1, to afford a margin by the sagging. Accordingly, the bag main body 6 deforms smoothly conforming the inner configuration of the dry container 1, by which the breakage of the bag main body can effectively be prevented.

When the operation for charging the granular goods to the inside of the liner bag main body 6 has been completed, the snap-buttons 18 are detached from the not illustrated engaging portions of the bulkhead 17, while the closing cover 19 is closed with the lower end thereof being provisionally secured to the door face 406 by means of the velvet fastners 20.

In this case, it may also be adapted such that the closing cover 19 is closed without disengaging the snap-buttons 18 from the engaging portion of the bulkhead 17 while leaving the lower end of the cover to suspend on the outer surface of the bulkhead 17. In this case, it is more preferable to dispose the velvet fastners 20 to the upper outer surface of the bulkhead 17 instead of the door face 406, such that the lower end of the closing cover 19 suspended to the outer surface of the bulkhead 17 can provisionally be secured to the outer surface of the bulkhead 17.

Upon landing the goods, the lower end of the door face 406 is cut out, for example, by using a knife after upwardly sliding the bulkhead 17 or by way of the opening formed to the bulkhead 17. Then, the goods present in the portion on the side of the doors 3 are discharged from the cut out portion. Then, when the goods are no more discharged through the cut out portion spontaneously, the dry container 1 is inclined to discharge the goods continuously.

After completing the landing, the liner bag 5 is detached from the dry container 1 and then discarded by the procedures contrary to those upon installation.

By installing the liner bag 5 to the inside of the dry container 1, the dry container 1 can be used as the bulk container. Further, since the liner bag 5 serves as the inner case, the goods can be transported under a sanitary condition without contaminating the inner wall of the dry container 1, which is particularly preferred upon transporting food stuffs. Furthermore, since the heat insulating performance can be improved by the liner bag 5, degradation of the goods due to the change in the atmospheric temperature can be reduced.

Further, since the charging port 16 is of a large size, the goods can be charged to the inside of the bag main body 6 by using any optional cargo loading machine. Furthermore, since the upper portion of the charging port 16 is pulled upwardly by using the anti-sagging hooks 22 and the lower edge of the charging port 16 is secured by means of the snap-buttons 18 to the bulkhead 17, the upper edge of the door face 406 does not sag downwardly even if the size of the charging port 16 is enlarged and there is no possibility that the charged goods should fall between the door face 406 and the bulkhead 17.

Although the explanations have been made to the foregoing embodiment, in which the opening area of the charging port 16 is always constant, it may some time be demanded to reduce the downward cutting length for the charging port 16 such that an increased amount of goods can be charged to the inside of the bag man body 6.

FIGS. 10 through 15 respectively illustrate other embodiments according to this invention capable of satisfying such a demand and explanations will now be made to these embodiments.

Figure 10:
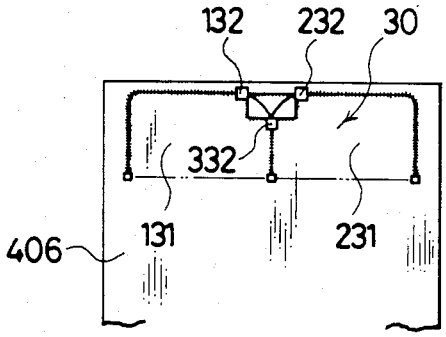

Specifically, in the embodiment shown in FIG. 10, an inverted U-shaped cut is formed to the upper portion of the door face 406 with an additional vertical cut being formed at the center between the right and left cuts to form a charging port 30, as well as right and left closing covers 131 and 231 for closing and opening them. Three slide fastners 132, 232 and 332 are disposed to the respective cuts.

With such a constitution, opening/closing operation for the entire charging port 30, as well as adjustment of the opening area can be made by completely closing the slide fastner 332, while slidably adjusting the slide fastners 132 and 232. Further, the opening/closing operation and the adjustment for the opening area can be made only to one of the right and left halves of the charging port 30 by completely closing either one of the right and left slide fastners 132 and 232, while slidably adjusting the other of the slidable fastners 212 and 232. Furthermore, since the charging port 30 can be closed by the right and left closing covers 131 and 231, it is not necessary to provide an additional closing cover to the outer surface of the charging port 30.

Figure 11:
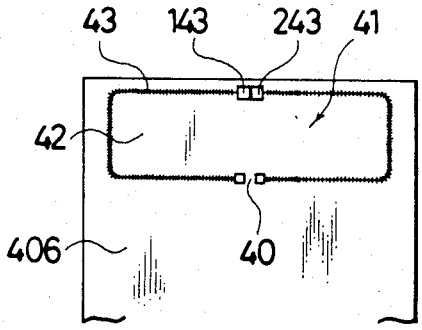

Further, in the embodiment shown in FIG. 11, a laterally elongated rectangular cut is formed at the upper portion of the door face 406 with an uncut portion 40 being left at the lower central part to form a charging port 41 and a closing cover 42 for closing and opening the port 41, and a single slide fastner 43 having two sliders 143 and 243 are disposed along the cut.

With such a constitution, the opening/closing operation and the adjustment of the opening area for the entire charging port 41 can be effected by slidably adjusting both of the sliders 143 and 243. Further, the opening/closing operation can be made only to either one of the right and left halves of the charging port 41 by situating either one of the sliders 143 and 243 at the illustrated position, while sliding the other of the sliders 243 and 143 up to the uncut portion 40. Furthermore, by sliding the other of the slider 243 and 143 toward one of the slider 143 and 243 in this state, the opening area can be adjusted only to one of the right and left halves of the charging port 41 although the shape of the opening is triangle in this case. In addition, due to use of the closing cover 42, no additional closing cover is required as in the case of FIG. 10.

Figure 12:
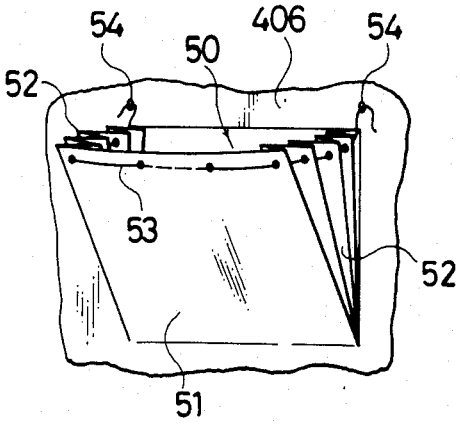
Figure 13:
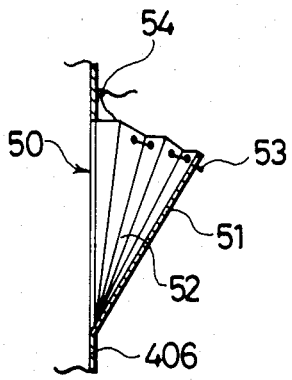

In the embodiment shown in FIGS. 12 and 13, an inverted U-shaped cut is formed to the upper portion of the door face 406 to constitute a charging port 50 and an closing cover 51 for closing and opening the port 50, as well as both of the lateral edges of the charging port 50 and those of the closing cover 51 are connected by means of fan-like bellows 52 and a rope 53 is disposed along the edges of the closing cover 51 and the bellows 52, so that both ends of the rope 53 can be drawn by way of engaging rings 54.

With such a constitution, the opening/closing operation for the charging port 50 and the adjustment for the opening area are enabled by adjusting the drawing amount of the rope 53. Further, since the rope 53 is disposed along the edge of the bellows 52 and the closing cover 51, there is no risk that the closing cover 51 or the bellows 52 are suspended excessively thereby causing leakage of the goods. Furthermore, reliable operation can be attained even if the shape of the charging port 50 is deformed due the pressure of the goods.

Figure 14:
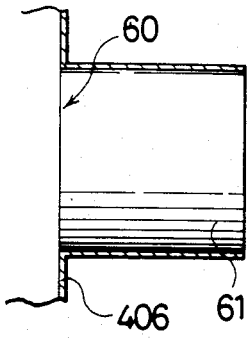

In the embodiment shown in FIG. 14, a soft tubular body 61 is attached to the charging port 60 disposed at the upper portion of the door face 406 and the opening of the tubular body 61 may be opened or closed by a string not illustrated.

With such a constitution, the opening area for the tubular body 61 can be adjusted by the drawing adjustment of the string, by which the opening area for the charging port 60 can substantially be adjusted.

Figure 15:
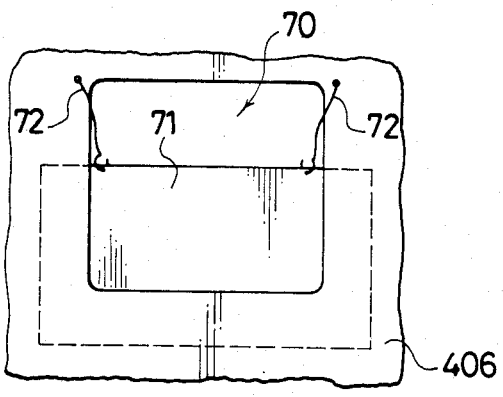

Further, in the embodiment shown in FIG. 15, a closing plate 71 such as made of a corrugated paper sheet is disposed to the inside of a charging port 70 formed at the upper portion of the door face 406 and the closure plate 71 is suspended such that the vertical position of the plate 71 is adjustable by suspending strings 72.

With such a constitution, the opening area for the charging port 70 can be adjusted by a simple structure.

Although the embodiments shown in FIGS. 12 through 15 can also be applied to the case where the charging port is in a laterally extended large shape as in the above-mentioned embodiments or those embodiments shown in FIGS. 10 and 11, it is applied particularly suitably to the case where two small circular or rectangular charging ports are disposed to the upper portion of the door face 406.

With the structure as shown in FIGS. 10 through 15, the opening area for the charging port can optionally be adjusted to thereby satisfactorily cope with the demand of charging a greater amount of goods into the liner bag main body 6.

FIGS. 16 through 19 show further embodiments of this invention respectively regarding the discharging portion disposed at the lower portion of the door face 406 and the explanations will now be made thereto.

Figure 16:
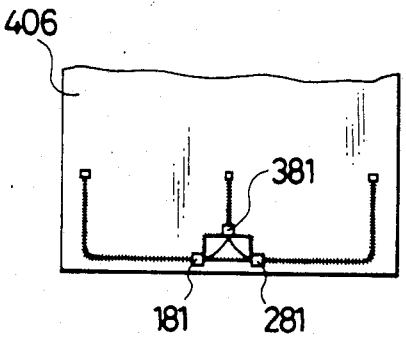

Specifically, in the embodiment illustrated in FIG. 16, cuts of a shape inverted vertically to that in FIG. 10 is formed at the lower portion of the door face 406 and slide fastners 181, 281 and 381 are disposed to the cuts.

With such a constitution, the size for the portion of discharging goods can freely be adjusted by the slidable adjustment for the slide fastners 181, 281 and 381 and the goods can be discharged without using a knife or the like. Further, since the good discharging portion can freely be opened or closed, the liner bag main body 6 can be used repeatedly.

Figure 17:
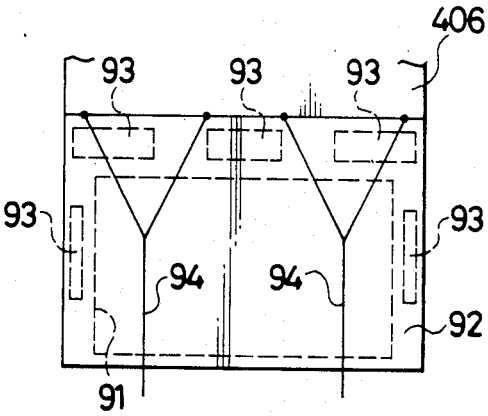

In the embodiments shown in FIGS. 17 and 18, a charge/discharge port 91 is formed to the lower portion of the door face 406 and a closing cover 92 connected at its lower end to the bottom face 106 is disposed to the outer surface. The upper end and both sides of the closing cover 92 may provisionally be secured, for example, by means of velvet fastener 93, while two pulling strings 94 biforkated at the upper end are attached to the upper end of the closing cover 92 such that the pulling strings 94 are led out externally from the lower portion of the bulkhead 17 passing through the outer surface of the closing cover 92.

With such a constitution, the charging port 91 is opened by pulling the strings 94 and the goods can be discharged without using knife or like other means. Further, the liner bag main body can be used repeatedly.

In the embodiment shown in FIG. 19, a discharging port 101 is formed to the lower portion of the door face 406 and this port 101 is closed by a closure plate 102, for example, made of corrugated paper sheets disposed between the door face 406 and the bulkhead 17.

With such a constitution, the discharging port 101 is opened by detaching the closure plate 102 and the goods can be discharged without using knife or like other means. In addition, the liner bag main body 6 can be used repeatedly.

In the case of the embodiments in FIGS. 17 through 19, it is not always necessary that the discharging ports 91 and 101 be formed initially, but the opening perforated by using a knife, etc. in the first use of the bag main body 6 may be utilized as the discharging ports 91 and 101 upon using the liner bag main body 6 at the second and succeeding times.

With the constitution as illustrated in FIGS. 16 through 19, the liner bag main body 6 can be used again.

FIGS. 20 through 22 illustrate still further embodiments according to this invention regarding the shape of the upper face 506, in which the embodiment shown in FIG. 20 comprises a joining edge between the upper face 506 and each of the side faces 206, which is flexed inwardly in an angled shape with the longitudinal center being as the apex, while the embodiment in FIG. 21 comprises a joining edge between the upper face 506 and each of the side faces 206, which is flexed twice inwardly into a trapezoidal shape with the line near the longitudinal center being as the upper side. Further, the embodiment shown in FIG. 22 comprises only one joining edge with the side face 206 on the right in the figure, which is in an arcuate shape convexed inwardly with the longitudinal center being as the crest.

With such a constitution although the anti-sagging effect can somewhat be reduced as compared with the case of the embodiment shown in FIG. 5, sufficient anti-sagging effect can still be obtained as compared with the case where both of the side edges of the upper face 506 are made straight.

While explanations have been made to each of the above-mentioned embodiments and other embodiments, in which the liner bag 5 is installed to the dry container, it may also be applied to the bulk container. In this case, it is, however, necessary to dispose the charging ports to the upper face 506 of the liner bag main body 6 corresponding to the manholes at the ceiling wall of the bulk container.

Further, although explanations have been made to the above-mentioned embodiment and other embodiments by taking an example of the liner bag 5 for use in the granular goods, it can also be applied to the transportation of hides or the likes. In this case, it is, however, necessary that the door face 406 of the bag main body 6 can be opened or closed, or a large opening is formed in the door face 406 so that goods can be conveyed to the inside of the bag main body 6 by using a fork lift or the like.

Furthermore, since the liner bag main body 6 is water-proof, it may be considered that droplets are deposited to the inner face of the bag main body 6 depending on the conditions of the atmospheric air, although no particular explanations therefor have been made in the foregoing embodiments and other embodiments. Then, it is desirable in such a case to append water-proof paper ordinarily used in the container on the lower surface of the upper face 506.

Furthermore, explanations have been made to the foregoing embodiments and other embodiments for the case where only both of the upper corners of the door face 406 are secured to the dry container 1 while freely leaving the both of the lower corners of the door face 406. However, if both of the lower corners of the door face 406 are also adapted to be secured on the dry container 1, the mounting state of the liner bag 5 is made more stable, which is particularly effective in the case of using the liner bag for the heavy weight goods.

As has been described above according to this invention, the liner bag can be installed to and removed from the container with an extremely easy operation, as well as the sagging in the upper face of the liner bag can be prevented without reducing the volume of the liner bag.

This invention is no way limited only to the specific embodiments described and illustrated described above unless restricted by the appended claims since this invention can be constituted broadly into other different embodiments than above without departing the spirit and the scope of the invention.

What is claimed is:

1. A liner bag for use in containers comprising :

a liner bag main body having a bottom face at least covering the container bottom wall, a pair of side faces covering both of the container side walls respectively, a front face covering the container front wall and an upper face covering the container upper wall, in which the joining edge between the upper face and at least one of the side faces is curved convexly toward the joining edge with the other of the side faces;

engaging members for detachably engaging the portions near the upper and lower four corners of the said main body on the front side respectively to the container;

a pair of engaging metal members attached respectively to the two upper corners of the container on the side of a door; and a pair of side belts which are attached along the joining edges between said upper face and both of said side faces respectively, the ends of which are led out from the ends of the upper face on the side of said door and in which the led out portions are clamped with each other after being engaged to the engaging metal members respectively.

2. A liner bag for use in containers as defined in claim 1, wherein the joining edge between the upper face and at least one of the side faces is bent in an arcuate shape with the longitudinal center of the joining edge being as a crest.

3. A liner bag for use in containers as defined in claim 1, wherein the joining edge between the upper face and at least one of the side faces is bent in a multiflexed shape with the longitudinal center of the connection edge being as a crest.

4. A liner bag for use in containers as defined in claim 1, wherein the upper portion at the front face of the liner bag main body is formed as a sloped plane inclined gradually to the side of the door toward the upper edges.

* * * * *